US010820777B2

(12) United States Patent
Kim et al.

(10) Patent No.: US 10,820,777 B2
(45) Date of Patent: Nov. 3, 2020

(54) DISHWASHER

(71) Applicant: LG ELECTRONICS INC., Seoul (KR)

(72) Inventors: Baekhon Kim, Seoul (KR); Donghwi Park, Seoul (KR); Jinhong Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 222 days.

(21) Appl. No.: 15/747,991

(22) PCT Filed: Jul. 26, 2016

(86) PCT No.: PCT/KR2016/008144

§ 371 (c)(1),
(2) Date: Jan. 26, 2018

(87) PCT Pub. No.: WO2017/018773

PCT Pub. Date: Feb. 2, 2017

(65) Prior Publication Data

US 2018/0214000 A1 Aug. 2, 2018

(30) Foreign Application Priority Data

Jul. 27, 2015 (KR) ..... 10-2015-0105623
Jul. 27, 2015 (KR) ..... 10-2015-0105678

(51) Int. Cl.
*A47L 15/42* (2006.01)

(52) U.S. Cl.
CPC ..... *A47L 15/4223* (2013.01); *A47L 15/4214* (2013.01); *A47L 15/4221* (2013.01)

(58) Field of Classification Search
USPC ..... 134/103.1, 56 D, 58 D, 25.2, 57 D, 109, 134/115 R, 186, 94.1, 104.2, 108, 18
See application file for complete search history.

(56) References Cited

U.S. PATENT DOCUMENTS 4,307,742 A * 12/1981 Schrott ..... A47L 15/4229 134/115 R
6,823,878 B1 * 11/2004 Gadini ..... A47L 15/4229 134/109

(Continued)

FOREIGN PATENT DOCUMENTS

EP 1 800 589 6/2007
EP 2 684 508 1/2014

(Continued)

OTHER PUBLICATIONS

Cho, Tae Hwan; "Dish washer", Oct. 2007, KR-20070105048—Machine Translation (Year: 2007).*

(Continued)

*Primary Examiner* — David G Cormier
*Assistant Examiner* — Thomas Bucci
(74) *Attorney, Agent, or Firm* — Ked & Associates, LLP

(57) ABSTRACT

A dishwasher according to the present invention comprises: a tub providing a washing space; a sump communicating with the tub through a recovery hole, and storing washing water; and a flow path portion installed on one surface of the tub, and supplying washing water to the tub and the sump. The flow passage portion includes: a water supply passage connected to a water supply source and receiving washing water; a first flow passage connected to the water supply passage and receiving washing water, and supplying washing water to the tub; and a second flow passage connected to the water supply passage and receiving washing water, and supplying washing water to the sump. The present invention has the advantages in that washing water can be supplied simultaneously to the tub and the sump, and washing water flowing in reverse in the sump can be prevented even when there is negative pressure in washing water being supplied to the sump.

20 Claims, 4 Drawing Sheets

(56) References Cited

U.S. PATENT DOCUMENTS 7,434,587 B2 * 10/2008 Jeong ..... A47L 15/4223 134/58 D
7,758,703 B2 * 7/2010 Lee ..... A47L 15/4285 134/56 D
7,819,986 B2 * 10/2010 Ryu ..... A47L 15/4244 134/56 D
8,091,569 B2 * 1/2012 Jeong ..... A47L 15/4223 134/103.1
8,317,936 B2 * 11/2012 Woo ..... A47L 15/0002 134/104.2
9,023,156 B2 * 5/2015 Han ..... A47L 15/4217 134/56 D
2004/0103930 A1 * 6/2004 Lee ..... A47L 15/4229 134/93
2004/0163689 A1 * 8/2004 Lee ..... A47L 15/4223 134/94.1
2005/0115592 A1 * 6/2005 Lee ..... A47L 15/4223 134/57 D
2005/0178406 A1 * 8/2005 Kang ..... A47L 15/4229 134/18
2005/0236019 A1 * 10/2005 Bang ..... A47L 15/4244 134/56 D
2005/0236020 A1 * 10/2005 Bang ..... A47L 15/4244 134/56 D
2005/0241675 A1 * 11/2005 Jung ..... A47L 15/4244 134/18
2007/0102027 A1 * 5/2007 Bang ..... A47L 15/4217 134/43
2007/0131257 A1 * 6/2007 Lee ..... A47L 15/4285 134/56 D
2007/0131261 A1 * 6/2007 Lee ..... A47L 15/4234 134/112
2008/0072930 A1 * 3/2008 Pyo ..... A47L 15/4202 134/25.2
2009/0139547 A1 * 6/2009 Park ..... A47L 15/0023 134/25.2
2013/0032180 A1 * 2/2013 Ak ..... A47L 15/4217 134/184
2013/0032181 A1 * 2/2013 Shin ..... A47L 15/4217 134/184
2015/0068056 A1 * 3/2015 Jung ..... A47L 15/488 34/218

FOREIGN PATENT DOCUMENTS

JP 2001-258812 9/2001
KR 10-0550853 2/2006
KR 100550853 B1 * 2/2006
KR 10-2007-0105048 10/2007
KR 20070105048 A * 10/2007
KR 10-2009-0030987 3/2009
KR 10-2013-0015287 2/2013
KR 10-2013-0025263 3/2013

OTHER PUBLICATIONS

Chung, Myounghwa; "Multi functional panel to supply washing liquid", Feb. 2006, KR-100550853 (Year: 2006).*
International Search Report dated Nov. 24, 2016 issued in Application No. PCT/KR2016/008144.
European Search Report dated Feb. 12, 2019 issued in Application No. 16830806.2.

* cited by examiner

DISHWASHER

CROSS-REFERENCE TO RELATED PATENT APPLICATIONS

This application is a U.S. National Stage Application under 35 U.S.C. § 371 of PCT Application No. PCT/KR2016/008144, filed Jul. 26, 2016, which claims priority to Korean Patent Application Nos. 10-2015-0105623, filed Jul. 27, 2015 and 10-2015-0105678, filed Jul. 27, 2015, whose entire disclosures are hereby incorporated by reference.

TECHNICAL FIELD

The present invention relates to a dishwasher.

BACKGROUND ART

In general, a dishwasher means an apparatus in which a target of washing is received in a washing space and which removes filth remaining on the target of washing using washing water and can also dry the target of washing target according to circumstances.

The dishwasher is home appliances for washing food residues on a surface of a dish using washing water of high pressure sprayed by a spray nozzle. The dishwasher includes a tub in which a washing tub is formed and a sump disposed at the bottom of the tub to store washing water. A washing cycle, a rinse cycle and a dry cycle are sequentially performed in the dishwasher.

A dishwasher having a dry function includes dry means for removing moisture remaining on a dish by supplying heated air to the inside of the tub. The dry means may include a heater for heating air and a fan for ventilating air heated by the heater. Furthermore, during a dry process, humid air is chiefly removed using zeolite or a heat pump system.

A method of sending washing water to the sump includes a method of supplying washing water to the inside of the tub so that it flows into the sump (tub feed water type) and a method of directly supplying washing water to the sump (sump feed water type).

In the tub feed water type, a feed water pipe directly connects a water supply source and the tub. The tub maintains atmospheric pressure because it corresponds to a very large space compared to the feed water pipe and communicates with external air in a process of opening and closing a door. Accordingly, since the feed water pipe is connected to the tub, negative pressure is not generated in the water supply source and the feed water pipe. That is, a separate inverse water pressure prevention structure is not necessary.

The sump feed water type is a method of spraying washing water to the tub again after passing through the water supply source and the sump. Various salt or ions are mixed in supplied tap water depending on the country. Accordingly, the sump feed water type corresponds to a structure for filtering salt or ions through the sump before washing water is supplied to the tub.

However, the sump feed water type had a problem in that washing water (also including washing water to be drained after washing) within the sump flows backward and drains due to generated negative pressure if water pressure of the water supply source is temporarily low.

Furthermore, a structure in which drainage must be performed by the sump has a problem in that all of washing water within the sump is drained due to a siphon phenomenon although some amount of washing water must remain within the sump.

DISCLOSURE

Technical Problem

The present invention has been proposed to solve the aforementioned problems, and an object of the present invention is to provide a dishwasher capable of simultaneous supply of water to a tub and a sump.

An object of the present invention is to provide a dishwasher which prevents washing water from flowing backward from a sump during the water supply and drainage of the washing water.

An object of the present invention is to provide a dishwasher which prevents washing water flowing into a water softener from flowing backward.

An object of the present invention is to provide a dishwasher which prevents washing water stored in a sump from being discharged to the outside of the sump although negative pressure is generated in a water supply source.

An object of the present invention is to provide a dishwasher equipped with a flow channel unit which prevents washing water stored in a sump from being discharged to the outside of the sump although negative pressure is generated in a water supply source.

An object of the present invention is to provide a dishwasher capable of preventing damage to a flow channel unit when a tub is installed.

An object of the present invention is to provide a dishwasher which performs a function for heating washing water and a function for circulating washing water.

Technical Solution

A dishwasher according to the present invention includes a tub providing a washing space; a sump communicating with the tub through a recovery hole and storing washing water; and a flow channel unit disposed on one surface of the tub to supply washing water to the tub and the sump, wherein the flow channel unit includes a water supply flow channel connected to a water supply source and supplied with washing water; a first flow channel connected to the water supply flow channel, supplied with the washing water, and supplying the washing water to the tub; and a second flow channel connected to the water supply flow channel, supplied with washing water, and supplying the washing water to the sump.

The water supply flow channel may be connected to the first flow channel and the second flow channel and configured to simultaneously supply the washing water to the first flow channel and the second flow channel.

The flow channel unit may further include a communication unit through which the water supply flow channel is exposed to external air.

The communication unit may include a first communication unit through which the water supply flow channel communicates with the inside of the tub; and a second communication unit through which the water supply flow channel communicates with the outside of the tub.

The first flow channel and the second flow channel may be branched from the branching point of the water supply flow channel.

The water supply flow channel may be formed to move washing water from a lower side to an upper side, and the first flow channel and the second flow channel may be formed to move washing water from the upper side to the lower side.

A communication unit through which the branching point is exposed to external air may be further formed in the flow channel unit.

A drainage flow channel discharging the washing water stored in the sump to the outside may be further included. The flow channel unit may further include a drainage flow channel unit connected to the drainage flow channel to guide the discharge of the washing water stored in the sump.

One side of the drainage flow channel unit may be connected to the sump through a drainage connection pipe, and the other side of the drainage flow channel unit may be connected to the drainage flow channel.

The flow channel unit may further include a communication unit through which the drainage flow channel unit is exposed to external air.

A check valve disposed between the drainage flow channel and the communication unit and selectively driven to expose the drainage flow channel unit to external air may be further included.

The communication unit may include a first communication unit through which the water supply flow channel communicates the inside of the tub; and a second communication unit through which the water supply flow channel communicates with the outside of the tub. The dishwasher may further include an air discharge stage connecting the second communication unit and the check valve so that air communicates.

The air discharge stage may be formed toward the first communication unit. When washing water is drained, washing water overflowing the check valve may be guided into the first communication unit through the air discharge stage.

A siphon brake selectively connecting the communication unit and the drainage flow channel unit and selectively exposing the drainage flow channel unit to atmospheric pressure may be further included.

The siphon brake may include: a connection chamber connected to the drainage flow channel unit; and a check valve selectively opening and closing the connection chamber and the second communication unit.

The flow channel unit may further include a guider externally protruded to prevent the flow channel unit from colliding against a cabinet.

The guider may include a guider body protruded from the flow channel unit; and a bent part bent from a free end of the guider body.

The guider body may be located on the same plane as the outer side of the flow channel unit.

The bent part may be bent toward the inside of the cabinet.

A dishwasher according to the present invention includes a tub providing a washing space; a sump communicating with the tub through a recovery hole and storing washing water; and a flow channel unit disposed on one surface of the tub to supply washing water to the tub and the sump, wherein the flow channel unit includes a housing disposed on one surface of the tub; a water supply flow channel disposed in the housing, connected to a water supply source and supplied with washing water; a first flow channel disposed in the housing, connected to a water supply flow channel and supplied with washing water, the first flow channel supplying the washing water to the tub; a second flow channel disposed in the housing, connected to the water supply flow channel and supplied with washing water, the second flow channel supplying the washing water to the sump; a drainage flow channel unit disposed in the housing and connected to a drainage flow channel discharging washing water of the sump to the outside, the drainage flow channel unit guiding the discharge of the washing water stored in the sump; and a communication unit disposed in the housing to expose at least any one of the water supply flow channel and the drainage flow channel unit to atmospheric pressure.

Advantageous Effects

The dishwasher according to the present invention may have one or more following effects.

First, the present invention has advantages in that it can supply washing water to the tub and the sump at the same time and can prevent washing water from flowing backward from the sump although negative pressure is generated in washing water supplied to the sump.

Second, the present invention has an advantage in that it can prevent the flowing backward of washing water from the sump because the water supply flow channel for supplying washing water to the sump is exposed to atmospheric pressure if negative pressure is generated in a water supply source.

Third, the present invention has an advantage in that it can prevent the flowing backward of washing water drained from the sump.

Fourth, the present invention has an advantage in that it can prevent washing water flowing into the water softener from flowing backward.

Fifth, the present invention has an advantage in that it can prevent washing water from flowing backward from the sump because washing water is supplied to the sump through the flow channel unit disposed in the tub and atmospheric pressure is exposed to a water supply source through the structure of the flow channel unit if negative pressure is generated in the water supply source.

Sixth, the present invention has advantages in that the washing water of the sump is discharged through the flow channel unit disposed in the tub and the siphon brake to block a siphon phenomenon is provided in the flow channel unit.

Seventh, the present invention has an advantage in that it prevents the flowing backward of washing water from the sump and a siphon phenomenon through the configuration of the flow channel unit disposed in the tub.

Eighth, the present invention has an advantage in that atmospheric pressure can be exposed to a water supply source connected to the flow channel unit through a plurality of paths.

Ninth, the present invention has an advantage in that it can prevent damage through the guider formed in the flow channel unit when the tub is installed.

Tenth, the present invention has an advantage in that it can perform a function for heating washing water and a function for circulating washing water.

BEST MODE

Figure 1:
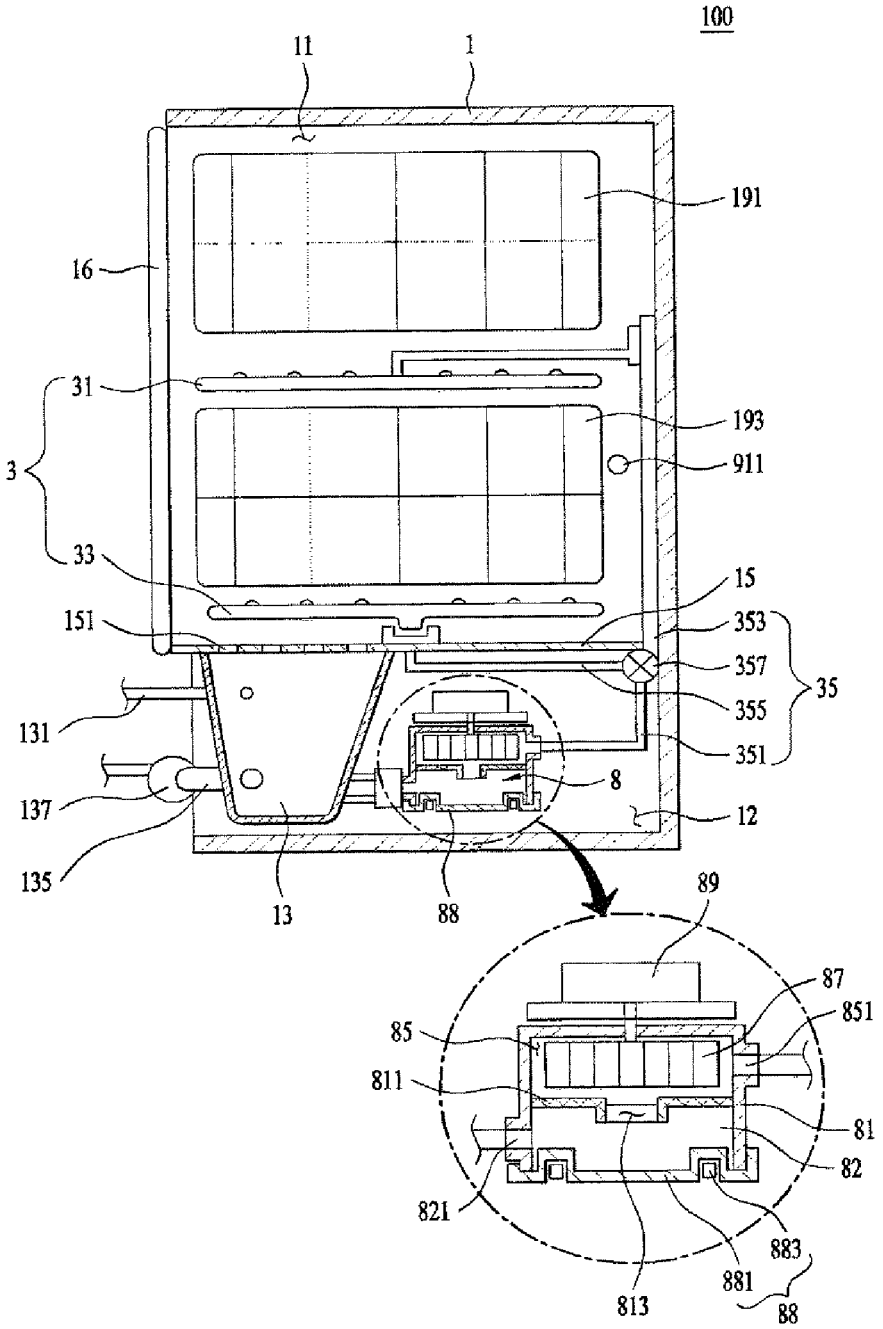
FIG. 1 is a schematic cross-sectional view of a dishwasher according to a first embodiment of the present invention.

Hereinafter, preferred embodiments of the present invention are described in detail with reference to the accompanying drawings. Meanwhile, the configuration of an apparatus or a control method to be described hereinafter are only for describing embodiments of the present invention and are not intended to limit the scope of a right of the present invention, and the same reference numerals used throughout the specification denote the same elements.

As shown in FIG. 1, a dishwasher of the present invention may include a cabinet 1, a tub 11 provided within the cabinet to receive a target of washing, a spray unit 3 spraying washing water to the target of washing, a sump 13 storing the washing water, and a circulation pump 8 supplying the washing water stored in the sump to the spray unit 3.

The cabinet 1 is provided to surround the tub 11 and forms an outward appearance of the dishwasher. The cabinet 1 may be substituted with kitchen furniture (a sink, etc.) or a wall equipped with a space in which the tub 11 can be received.

Racks 191 and 193 in which a target of washing is received are provided within the tub 11. The racks include a first rack 191 and a second rack 193 disposed under the first rack.

A washing space is formed within the tub 11. The washing space is open and closed by the door 16. Accordingly, a user may open a door and then draw the racks from the washing space or insert the racks into the washing space.

A base 12 is disposed at the bottom of the tub 11. The tub 11 is supported by the base 12. The sump 13 is fixed to the base and located under the tub.

The sump 13 is supplied with washing water through a water supply connection pipe 131, and discharges washing water through a drainage connection pipe 135 and a drainage pump 137.

The water supply connection pipe 131 may further include a water softener 133 lowering hardness of washing water. Hardness of water is a numerical value obtained by converting the amount of calcium and magnesium included in water into ppm of calcium carbonate. If hardness of water is high, washing performance of a dishwasher may be deteriorated because a detergent is not well dissolved. The water softener 133 is means for solving such a problem.

A sump cover 15 is disposed between the sump 13 and the tub 11. A recovery hole 151 is formed in the sump cover. The inside (washing space) of the tub and the sump communicate with each other through the recovery hole 151. Accordingly, the washing water of the tub is recovered by the sump through the recovery hole.

If the tub is equipped with the first rack and the second rack, the spray unit 3 may include a first spray arm 31 spraying washing water to the first rack 191 and a second spray arm 33 spraying washing water to the second rack 193.

The first spray arm and the second spray arm are supplied with washing water through an arm flow channel 35. The arm flow channel is provided to connect the spray arms 31 and 33 and the circulation pump 8.

The arm flow channel 35 may include a connection flow channel 351 connected to the circulation pump 8, a first arm flow channel 353 connecting the connection flow channel and the first spray arm 31, and a second arm flow channel 355 connecting the connection flow channel and the second spray arm 33. Accordingly, when the circulation pump 8 is driven, washing water within the sump 13 flows into the connection flow channel 351 and may be then supplied to the arms 31 and 33 through the arm flow channels 353 and 355.

The connection flow channel 351 is branched and connected to the first arm flow channel 353 and the second arm flow channel 355. A switch valve 357 may be provided at the branching point 953 of the first arm flow channel and the second arm flow channel. The switch valve 357 may selectively open the first arm flow channel and the second arm flow channel or may open them at the same time.

The circulation pump 8 may include a pump body 81 located within the base 12, a first chamber 82 provided within the pump body to communicate with the sump 13, a second chamber 85 communicating with the first chamber and to which the arm flow channel 35 is connected, and an impeller 87 provided in the second chamber.

The second chamber 85 is disposed over the first chamber 82. The first chamber 82 and the second chamber 85 are partitioned by a barrier rib 811 provided within the pump body 81. The barrier rib is equipped with a barrier rib through hole 813 through which the first chamber and the second chamber communicate with each other.

The first chamber 82 is connected to the sump 13 through a chamber inlet 821. The second chamber 85 is connected to the connection flow channel 351 through a chamber outlet 851.

The impeller 87 is rotated by a driving unit 89 located outside the pump body 81. Accordingly, when the impeller rotates, washing water within the sump 13 is introduced into the first chamber 82. The washing water introduced into the first chamber is introduced into the second chamber 85 through the barrier rib through hole 813, and then supplied to the connection flow channel 351 through the chamber outlet 851.

The washing water is raised from the first chamber 82 to the second chamber 85 by the driving of the impeller 87, and is then discharged through the chamber outlet 851.

The first chamber 82 may include a heater 88 heating washing water. The heater may include a heat transfer unit 881 forming the bottom surface of the first chamber 82 and a heating unit 883 heating the heat transfer unit. The heating unit 883 may include a heating element fixed to the heat transfer unit 881, located outside the first chamber, and generating heat when an electric current is supplied thereto.

In general, in a conventional dishwasher, the heater heating washing water is located within a chamber in which washing water is stored. In this case, there is a disadvantage in that the overheating of the heater can be prevented only when the control unit of the dishwasher controls a water level within the chamber so that the heater is not exposed to the outside of the washing water.

However, in the present invention, the entire bottom surface of the first chamber 82 forms the heat transfer unit (or conductor) 881, and the heat transfer unit is heated by the heating unit 883 located outside the first chamber. Accordingly, the present invention can prevent the overheating of the heater although a water level within the first chamber is not controlled.

Figure 2:
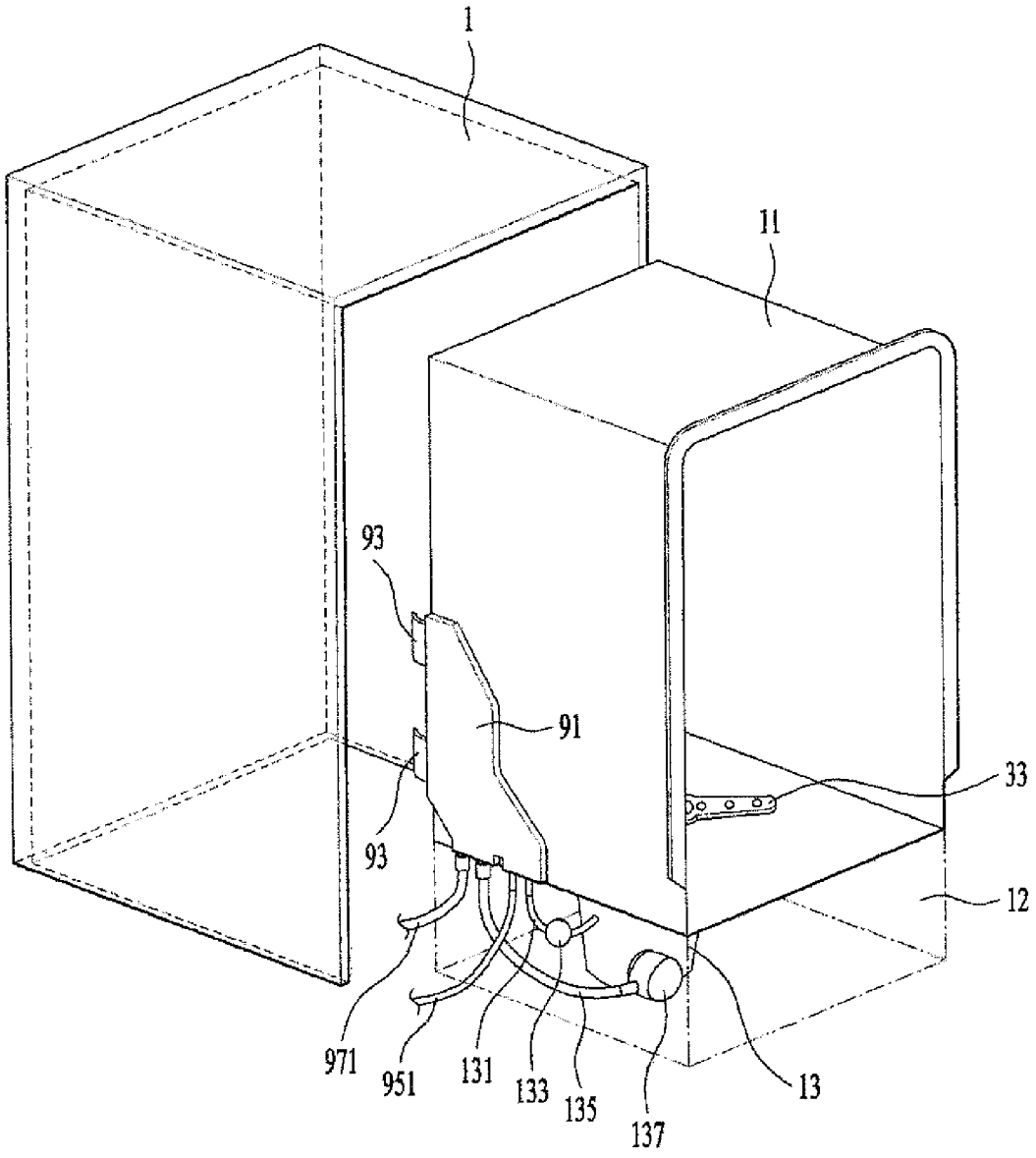
FIG. 2 is an exploded perspective view of a cabinet and tub according to a first embodiment of the present invention.
Figure 3:
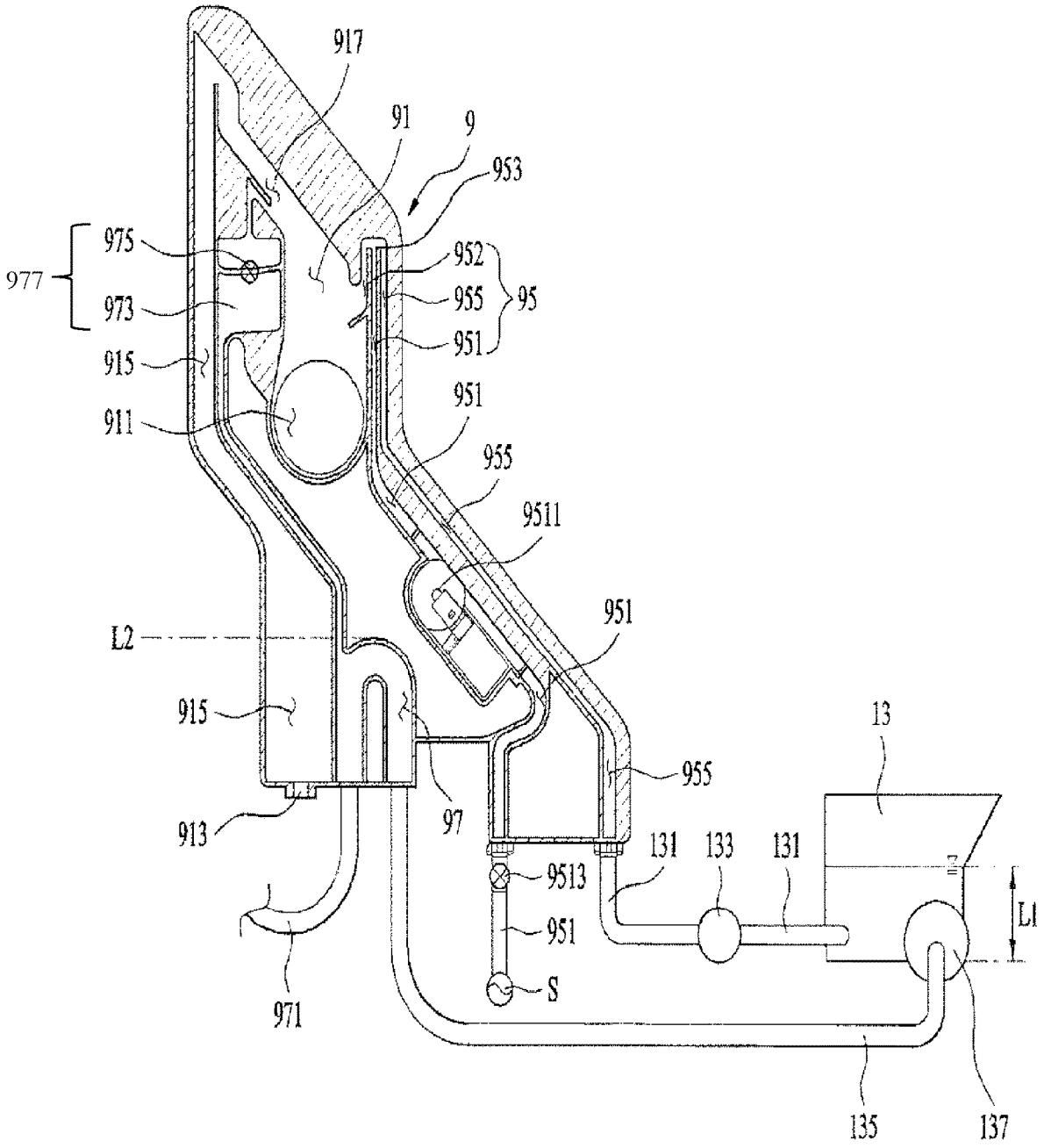
FIG. 3 is a cross-sectional view of a flow channel unit shown in FIG. 2.

As shown in FIG. 2 or 3, a flow channel unit 9 is connected to the sump 13. The flow channel unit 9 provides a flow channel to washing water supplied from the sump 13 to the tub 11. Furthermore, the flow channel unit 9 provides a flow channel to washing water discharged by the sump 13. The configuration of a flow channel can be simplified through the flow channel unit 9.

The water supply connection pipe 131 provided in the sump is connected to a water supply source S through the flow channel unit 9. The drainage connection pipe 135 discharges washing water within the sump 13 to the outside of the dishwasher through the flow channel unit 9.

The flow channel unit 9 includes a housing 91 fixed to one surface of the tub 11, a water supply flow channel unit 95 disposed within the housing to connect the water supply connection pipe 131 and the water supply source S, and a drainage flow channel unit 97 disposed within the housing 91 to connect the drainage connection pipe 135 and a drainage flow channel 971.

The housing 91 is disposed on the outside of the tub 11.

The housing 91 includes a first communication unit 911 communicating with the tub 11.

The water supply flow channel unit 95 includes a water supply flow channel 951 connected to the water supply source S, a first flow channel 952 connecting the water supply flow channel 951 and the first communication unit 911, and a second flow channel 955 connecting the water supply flow channel 951 and the water supply connection pipe 131.

Washing water supplied to the first flow channel 952 is supplied to the inside of the tub 11 through the first communication unit 911. Washing water supplied to the second flow channel 955 is supplied to the sump 13 through the water supply connection pipe 131.

The water supply flow channel 951 is branched to form the first flow channel 952 and the second flow channel 955.

The water supply flow channel 951 is formed to guide washing water from the lower side to the upper side. The branching point 953 of the first flow channel 952 and the second flow channel 955 is formed at the top of the water supply flow channel 951.

Washing water raised along the water supply flow channel 951 is divided into two directions. One flows to the first flow channel 952, and the other flows to the second flow channel 955. The first flow channel 952 and the second flow channel 955 guide washing water so that it flows from the upper side to the lower side.

That is, washing water raised up to the branching point 953 of the water supply flow channel 951 may flow into the first flow channel 952 or the second flow channel 955 by its self-weight even without separate pressure.

Through such a structure, although negative pressure is generated in the water supply source S, washing water stored in the sump 13 can be prevented from flowing backward to the inside of the housing 91.

The branching point 953 of the first flow channel 952 and the second flow channel 955 is connected to the tub 11 through the first communication unit 911. Accordingly, when negative pressure is generated in the water supply source S, air within the tub is supplied to the water supply flow channel 951 through the branching point 953.

Since the air is absorbed by the water supply flow channel 951, the washing water of the sump 13 can be prevented from flowing backward.

In order to control the amount of washing water supplied to the sump 13, the water supply flow channel 951 may be equipped with a flow measurement unit 9511. The water supply flow channel 951 may be open and closed by a valve 9513. Accordingly, a control unit (not shown) can control the amount of washing water supplied to the sump through the valve and the flow measurement unit.

The drainage flow channel unit 97 is provided within the housing 91. The drainage flow channel unit 97 connects the drainage connection pipe 135 and the drainage flow channel 971.

The drainage flow channel unit 97 is formed to pass through a point L2 higher than the highest water level L1 of washing water which may be stored in the sump 13. Accordingly, a specific amount of washing water may be stored in the sump. Such a structure is a structure for suppressing a siphon phenomenon.

When the drainage pump 137 is driven, washing water within the sump is discharged to the outside of the dishwasher through the drainage connection pipe 135 and the drainage flow channel 971. When the washing water of the sump 13 starts to be discharged by the driving of the drainage pump 137, all of the washing water within the sump 13 can be discharged by a siphon phenomenon although the driving of the drainage pump 137 is stopped. That is, washing water will remain within the drainage connection pipe 135 and the drainage flow channel 971 by the siphon phenomenon.

In order to prevent such a problem, the drainage flow channel unit 97 may include siphon brakes 977.

If the drainage flow channel 971 is connected to a drain, bad smell may flow into the sump 13 if washing water does not remain in the drainage connection pipe 135 or the drainage flow channel 971.

The drainage flow channel unit 97 connects the drainage connection pipe 135 and the drainage flow channel 971, but changes the direction of a flow channel up or down. For example, the drainage connection pipe 135 supplies washing water to the drainage flow channel unit 97 from the lower side to the upper side, and the drainage flow channel unit 97 supplies washing water to the drainage flow channel 971 from the upper side to the lower side.

That is, the flow direction of the washing water is changed 180 degrees by the drainage flow channel unit 97. In the present embodiment, the drainage flow channel unit 97 is formed in a "∩" shape.

The shape of the drainage flow channel unit 97 also functions as a siphon brake.

The siphon brakes 977 include a connection chamber 973 connected to the drainage flow channel unit 97 and a check valve 975 that opens and closes the connection chamber. The check valve is driven in response to pressure within the drainage flow channel unit 97. The check valve 975 is means through which the inside of the drainage flow channel unit 97 communicates with the inside of the housing 91.

The connection chamber 973 is connected to the top of the drainage flow channel unit 97.

When the drainage pump 137 is driven, the check valve 975 will close the connection chamber 973. When the driving of the drainage pump is stopped, however, the check valve 975 will open the connection chamber 973, so the inside of the connection chamber 973 communicates with the inside of the housing 91.

The housing 91 is connected to the inside of the tub 11 through the first communication unit 911. Accordingly, when the connection chamber 973 is open by the check valve 975, air flows into the drainage flow channel unit 97 through the connection chamber 973.

Accordingly, a siphon phenomenon is blocked because atmospheric pressure is provided to the inside of the drainage flow channel unit 97. When atmospheric pressure is provided to the drainage flow channel unit 97, some of washing water within the drainage flow channel unit 97 is discharged to the outside of the dishwasher through a drain pipe, and the remaining some of the washing water within the drainage flow channel 971 remains within the drainage connection pipe 135.

If some of washing water remains in the drainage connection pipe 135, bad smell can be prevented from entering the sump 13.

In order to implement the function of the siphon brake more effectively, the housing 91 may further include a second communication unit 913 that provides the drainage flow channel unit 97 with atmospheric pressure.

The second communication unit 913 may also be connected to the first communication unit 911. The inside of the housing communicates with the outside of the housing through the second communication unit 913.

The housing 91 may further include an air flow channel 915 connected to the second communication unit 913 to introduce air into the housing.

The air flow channel 915 may be connected to at least one of the connection chamber 973 and the first communication unit 911. In the present embodiment, the air flow channel 915 communicates with the connection chamber 973 and the first communication unit 911.

The air flow channel 915 communicates with the connection chamber 973 and the first communication unit 911 through an air discharge stage 917. The air flow channel is branched from the air discharge stage 917.

The air discharge stage 917 is preferably provided at a location higher than the check valve 975. Although washing water leaks to the outside of the connection chamber 973 through the check valve 975, the leakage of the washing water can be suppressed to some extent through the air discharge stage 917 located higher than the check valve 975.

Furthermore, the air discharge stage 917 is formed toward the first communication unit 911. Washing water that overflows the air discharge stage 917 is guided into the inside of the tub through the first communication unit 911. Although washing water discharged through the air discharge stage 917 overflows, the air flow channel 915 can prevent discharge washing water from leaking to the outside of the housing 91.

In the flow channel unit 9 having the aforementioned structure, when the tub 11 is coupled to the cabinet 1, there is a danger that the flow channel unit 9 may be damaged by the cabinet 1. Accordingly, a guider 93 may be further disposed in order to prevent the flow channel unit 9 from colliding against the cabinet 1 when the tub 11 is coupled to the cabinet 1.

Figure 4:
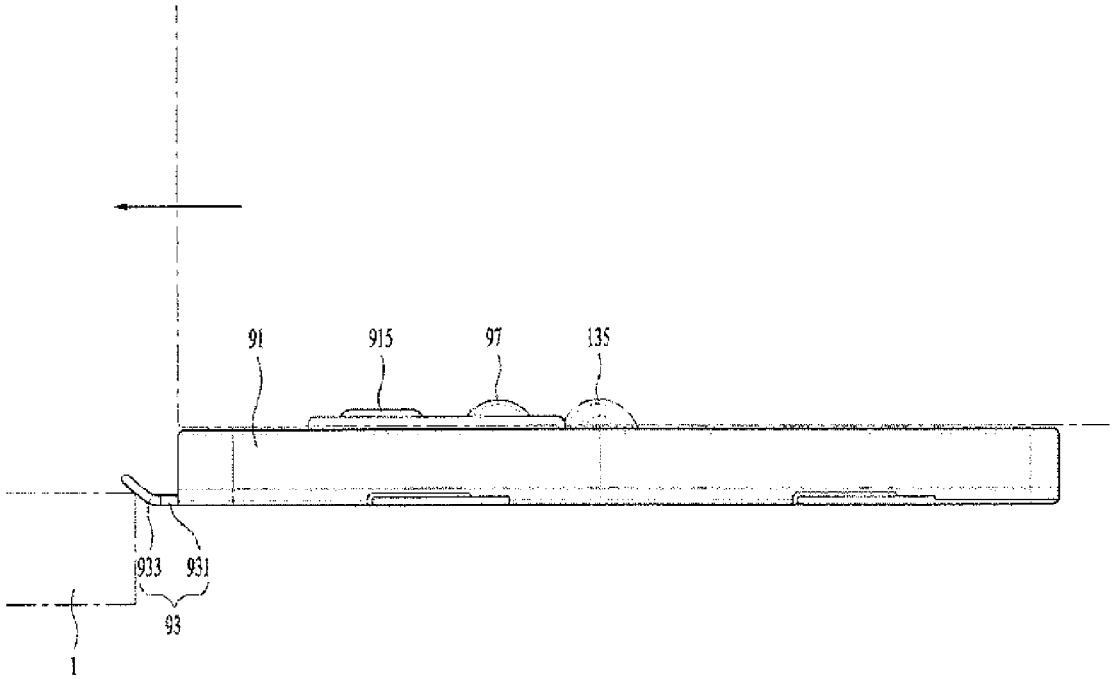
FIG. 4 is a plane view of a guider shown in FIG. 2.

As shown in FIG. 4, the guider 93 may include a guider body 931 fixed to the housing 91 and a bent part 933 bent from the free end of the guider body 931.

The guider 93 is disposed in the rear of the housing 91. A plurality of the guiders 93 may be disposed in the height direction.

The guider body 931 extended from the housing 91 is preferably disposed on the same plane as the housing 91. The guider body 931 is located on the same plane with respect to the outer side of the housing 91.

Unlike in the present embodiment, the guider body 931 may be fabricated as a separate member and may be fixed in such a way as to be protruded from a surface of the housing 91.

The bent part 933 is bent from the guider body 931 to the inside.

When the housing 91 collides against the cabinet 1, the guider 93 can protect the housing 91 and correct the direction in which the housing 91 is inserted.

The bent part 933 can guide the direction in which the housing 91 is inserted while it collides against the cabinet 1.

The present invention may be modified and practiced in various forms, and the scope of a right of the present invention is not limited to the aforementioned embodiments. Accordingly, if a modified embodiment includes elements of the claims of the present invention, it should be construed as belonging to the scope of a right of the present invention.

The invention claimed is:

1. A dishwasher, comprising:

a tub providing a washing space;

a sump communicating with the tub through a recovery hole and storing washing water; and a flow channel unit disposed on a surface of the tub to supply washing water to the tub and the sump, wherein the flow channel unit includes:

a housing configured to be fixed to a surface of the tub;

a first communication pathway provided in the housing and communicating with the tub;

a water supply flow channel provided in the housing, connected to a water supply source, and supplied with washing water from the water supply source;

a first flow channel provided in the housing, connected to the water supply flow channel, supplied with the washing water, and supplying washing water to the first communication pathway;

a second flow channel provided in the housing, connected to the water supply flow channel, supplied with washing water, and supplying washing water to the sump; and a branch point provided at an end of the water supply flow channel and dividing washing water flowing along the water supply flow channel to flow in two directions to, respectively, the first and second flow channels, wherein the first flow channel and the second flow channel are provided below the branch point.

2. The dishwasher of claim 1, further comprising:

a second communication pathway provided in the housing, and through which the water supply flow channel communicates with an outside of the tub.

3. The dishwasher of claim 1, wherein:

the water supply flow channel is formed to move washing water upward, and the first flow channel and the second flow channel are formed to move washing water downward.

4. The dishwasher of claim 1, further comprising a drainage flow channel discharging washing water stored in the sump, wherein the flow channel unit further includes a drainage flow channel pathway provided in the housing, connected to the sump through a drainage connection pipe, and connected to the drainage flow channel to guide discharge of washing water stored in the sump.

5. The dishwasher of claim 4, wherein:

a first side of the drainage flow channel pathway is connected to the sump through a drainage connection pipe, and a second side of the drainage flow channel pathway is connected to the drainage flow channel.

6. The dishwasher of claim 4, wherein the flow channel unit further includes a second communication pathway provided in the housing, and through which the drainage flow channel pathway receives air.

7. The dishwasher of claim 6, further comprising a check valve that is disposed between the drainage flow channel and the second communication pathway and is selectively driven to guide air to the drainage flow channel pathway.

8. The dishwasher of claim 7, wherein:

the dishwasher further comprises an air discharge stage connecting the second communication pathway and the check valve to enable air communications, and the air discharge stage is provided at a location higher than the check valve.

9. The dishwasher of claim 8, wherein:

the air discharge stage is formed in communication with the first communication pathway, and when washing water is drained, washing water overflowing the check valve is guided into the first communication pathway through the air discharge stage.

10. The dishwasher of claim 6, further comprising a siphon brake selectively connecting the second communication pathway and the drainage flow channel pathway and selectively exposing the drainage flow channel pathway to atmospheric pressure, wherein the siphon brake is provided at a location that is higher than the drainage flow channel.

11. The dishwasher of claim 10, wherein the siphon brake includes:

a connection chamber connected to the drainage flow channel pathway; and a check valve selectively opening and closing the connection chamber and the second communication pathway.

12. The dishwasher of claim 1, wherein the flow channel unit further includes a guider protrusion externally protruded from the housing and configured to prevent the housing of the flow channel unit from colliding against a cabinet.

13. The dishwasher of claim 12, wherein the guider protrusion includes:

a guider body protruded from the flow channel unit; and guider extension extending at an angle from a free end of the guider body.

14. The dishwasher of claim 13, wherein the guider body protrudes in a direction corresponding to an outer side of the housing of the flow channel unit.

15. The dishwasher of claim 14, wherein the guider extension extends from the free end of the guider body in a direction from the outer side of the housing and toward the surface of the tub where the flow channel unit is disposed.

16. A dishwasher, comprising:

a tub providing a washing space;

a sump communicating with the tub through a recovery hole and storing washing water;

a housing disposed on at least one surface of the tub;

a water supply flow channel disposed in the housing, connected to a water supply source, and supplied with washing water;

a first communication pathway disposed in the housing and communicating with the tub;

a second communication pathway disposed in the housing and through which the water supply flow channel communicates with an outside of the tub;

a first flow channel disposed in the housing, connected to the water supply flow channel, and supplying a first portion of washing water from the water supply flow channel to the first communication pathway;

a second flow channel disposed in the housing, connected to the water supply flow channel, and supplying a second portion of washing water from the water supply flow channel to the sump;

a drainage flow channel pathway disposed in the housing and connected to a drainage flow channel discharging washing water of the sump, the drainage flow channel pathway guiding discharge of washing water stored in the sump; and a branch point disposed at an end of the water supply flow channel and guiding washing water flowing along the water supply flow channel to flow in two directions to, respectively, the first and second flow channels, wherein the first flow channel and the second flow channel extend downward from the branch point.

17. The dishwasher of claim 16, wherein:

the water supply flow channel is formed to move washing water upward to the branch point, and the first flow channel and the second flow channel are formed to move washing water downward from the branch point.

18. The dishwasher of claim 16, further comprising:

a check valve that is provided between the drainage flow channel and the second communication pathway and is selectively driven to guide air to the drainage flow channel pathway.

19. The dishwasher of claim 18, wherein:

the dishwasher further comprises an air discharge stage connecting the second communication pathway and the check valve to enable air communications, and the air discharge stage is positioned higher than the check valve.

20. The dishwasher of claim 19, wherein:

the air discharge stage is formed in communication with the first communication pathway, and when washing water is drained, washing water overflowing the check valve is guided into the first communication pathway through the air discharge stage.

* * * * *